US006185951B1

(12) United States Patent
Lane et al.

(10) Patent No.: US 6,185,951 B1
(45) Date of Patent: Feb. 13, 2001

(54) TEMPERATURE CONTROLLED CASE

(75) Inventors: Mark Lane; Michael B. Davidson, both of Acworth, GA (US)

(73) Assignee: In-Store Products Ltd. (CA)

( * ) Notice: Under 35 U.S.C. 154(b), the term of this patent shall be extended for 0 days.

(21) Appl. No.: 09/348,924

(22) Filed: Jul. 6, 1999

(51) Int. Cl.[7] ..... A47F 3/04
(52) U.S. Cl. ..... 62/246; 62/257; 62/434
(58) Field of Search ..... 62/246, 257, 434, 62/435

(56) References Cited

U.S. PATENT DOCUMENTS

| | | | | |
|---|---|---|---|---|
| 2,136,232 | * | 11/1938 | Bromann, Jr. | 62/257 |
| 2,382,599 | * | 8/1945 | Blair | 62/257 |
| 2,660,864 | * | 12/1953 | Morris | 62/257 |
| 2,932,955 | * | 4/1960 | Hargrave et al. | 62/257 |
| 2,973,631 | * | 3/1961 | Adkins | 62/246 |
| 3,216,215 | * | 11/1965 | Schuett | 62/435 |
| 4,135,369 | | 1/1979 | Allgeyer et al. | 62/251 |
| 4,280,335 | * | 7/1981 | Perez et al. | 62/435 |
| 4,977,754 | | 12/1990 | Upton et al. | 62/248 |
| 5,277,486 | | 1/1994 | Bustos | 312/125 |
| 5,335,508 | * | 8/1994 | Tippmann | 62/434 |
| 5,381,670 | * | 1/1995 | Tippmann et al. | 62/434 |
| 5,819,549 | * | 10/1998 | Sherwood | 62/435 |

* cited by examiner

*Primary Examiner*—William E. Tapolcai
(74) *Attorney, Agent, or Firm*—Bachman & LaPointe, P.C.

(57) ABSTRACT

Case includes at least one compartment for product storage, at least one access opening providing entrance to said compartment and at least one shelf within the compartment for holding product. Refrigeration is provided operatively associated with the compartment for maintaining a selected temperature therein including at least one of (1) transparent cooling coils above the shelf with a cooling medium flowing therethrough, and (2) cooling within the shelf with a cooling medium therein, whereby a cooled, temperature controlled environment is provided for the products.

14 Claims, 4 Drawing Sheets

TEMPERATURE CONTROLLED CASE

BACKGROUND OF THE INVENTION

The present invention relates to a temperature controlled case for storage and display of chilled and/or frozen products, especially in a store environment.

A typical cooling coil in a refrigerated case is constructed of metal, such as copper or aluminum. Since this material is metal, it is quite noticeable when mounted in a refrigerated case. Case manufacturers try to conceal this coil by placing an attractive cover over the coil or placing the coil in a hidden location, as under the product shelf. However, although these methods hide the coil, they do not make the case particularly attractive and may affect refrigeration efficiency.

Refrigeration case shelving is generally made from painted metal or stainless steel. This type of shelving may be used to cover a forced air evaporator mounted beneath the shelf, or there may be a gravity feed coil mounted above the shelving. However, the main purpose of the shelving is to hold and display the product within the refrigerated case. Therefore, in both of the foregoing applications, the actual cooling of the product is achieved from the gravity feed coil mounted above the shelf or from the forced air coil mounted below the shelf, which is not entirely satisfactory.

Therefore, it is a principal object of the present invention to provide an improved, temperature controlled case for storage and display of cooled and/or frozen products.

It is a further object of the present invention to provide a case as aforesaid which is efficient and at the same time esthetically pleasing.

It is an additional object of the present invention to provide a case as aforesaid which may be readily and effectively used in a commercial store environment.

Further objects and advantages of the present invention will appear hereinbelow.

SUMMARY OF THE INVENTION

In accordance with the present invention, the foregoing objects and advantages are readily obtained.

The present invention provides a temperature controlled case for storage and display of chilled and/or frozen products, which comprises: at least one compartment for product storage; at least one access opening providing entrance to said compartment; at least one shelf within said compartment for holding product; refrigeration means operatively associated with said compartment for maintaining a selected temperature therein, wherein said refrigeration means includes at least one of (1) at least one transparent or semi-transparent cooling coil above said shelf with a cooling medium flowing therethrough, and (2) cooling within said shelf with a cooling medium flowing therethrough, as through cooling channels to provide a cooled, temperature controlled environment for the product.

The cooling coil or coils above the shelf may be made of glass, plexiglass or other transparent or semi-transparent material as transparent or semi-transparent plastic which is less noticeable in the case. Since the material is transparent or semi-transparent, a shielding will not be needed to conceal the coil. When used in conjunction with a clear or transparent cooling medium, the coil will go virtually undetected. If there is a need to color the coil, one can simply add a dye to the cooling liquid which will effectively alter the color of the coil.

When the cooling means is within the shelf, the shelving may be made from standard painted metal or stainless steel; however, in addition to the cooling effect from the refrigerant within the cooling coils in the shelf, the shelf itself will provide a cooling, thus adding to the refrigeration effect. Where this is used in combination with the cooling coils above the shelf, the cooling effect will be magnified.

Alternatively, the present invention may use an esthetically pleasing transparent or semi-transparent shelf design which has a more pleasing look than the metal shelving. The transparent or semi-transparent shelf design, with chilled liquid pumped therethrough, can be left clear or colored by simply adding a dye to the cooling liquid. Because the shelf itself is the actual background for the product on display, store marketing people can easily select a color that suits their marketing needs.

Further features and advantages of the present invention will appear hereinbelow.

BRIEF DESCRIPTION OF THE DRAWINGS

The present invention will be more readily understandable from a consideration of the following illustrative drawings, wherein.

DETAILED DESCRIPTION OF PREFERRED EMBODIMENTS

A typical cooling coil or coils in a refrigerated case is constructed of a metal, such as copper or aluminum. However, since this material is metal, it is quite noticeable when mounted in a refrigerated case and in fact may represent a significant eyesore. Case manufacturers try to conceal the coil by placing an attractive cover over the coil or by placing the coil under the product shelf. While these methods may hide the coil, they do not make the case very attractive and may not be an entirely satisfactory solution to the problem.

In addition to the foregoing, case shelving is made from painted metal or stainless steel. This type of shelf is used to cover a forced air evaporator mounted beneath it or a gravity feed coil is mounted above. The main purpose of the case shelf is to hold and display the product within the refrigerated case. In both applications, the actual cooling of the product is achieved from the gravity feed coil mounted above the shelf or from the forced air coil mounted below the shelf. Here also, these designs are not entirely satisfactory, both from an esthetic and practical point of view. Metal shelves, for example, are not very eye pleasing and do not give marketing personnel much design flexibility.

Figure 1:
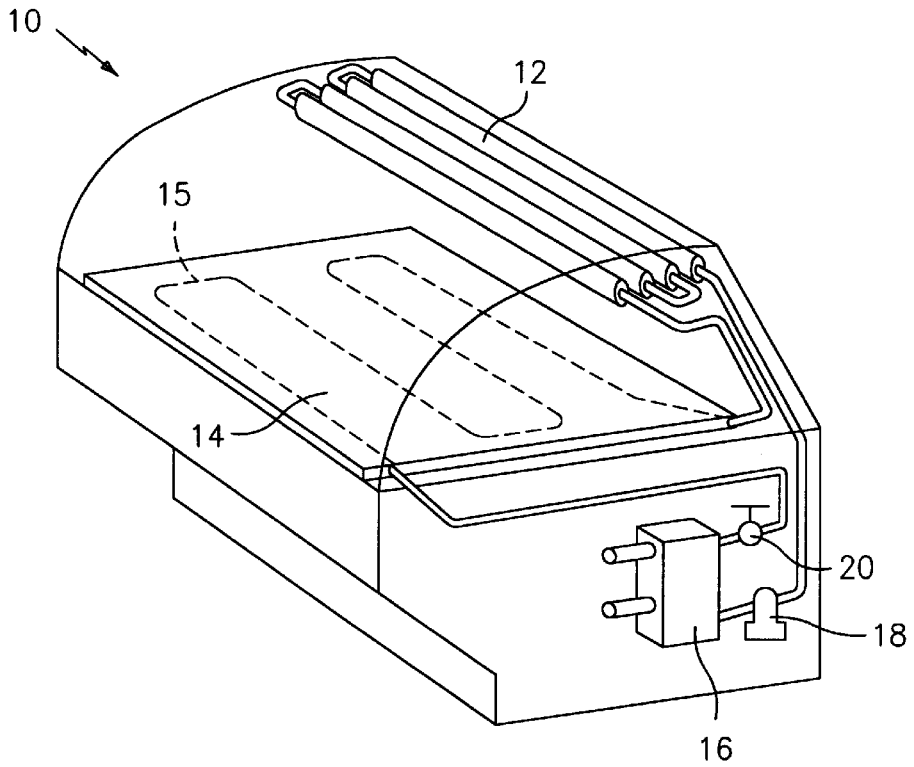
FIG. 1 is a perspective view of one embodiment of a temperature controlled case of the present invention.

FIG. 1 shows one embodiment of a temperature controlled case 10 of the present invention employing liquid filled transparent cooling coil 12, as for example glass, and liquid filled cooling shelf 14 in a cooling system which includes a plate heat exchanger 16, liquid pump 18 and liquid flow valve 20. A key feature to this case design is the attractive transparent glass tube cooling coil. Although this coil is visible, the liquid filled transparent material is very pleasing to the eye. The number of tubes needed, tube size and tube shape is determined based on case or product load. The location of this coil is above the product, thus causing a gravity feed cooling effect. Below the transparent cooling coil is the liquid filled cooling shelf. The cooling coil and cooling shelf share the same cooled liquid, encapsulating the product in a precisely controlled environment. The liquid filling the cooling coil and cooling shelf can be of multiple liquid types. Plain water, glycol or a brine solution can all be used based on the desired temperature being achieved. The case configuration shown in FIG. 1 is exemplificative only and naturally other case designs may readily be used within the parameters of the present invention.

The transparent cooling coil 12 shown in FIG. 1 is a key component of the present invention. The coil can be made of any material that is transparent in nature or a clear tinted material that retains transparent or semi-transparent characteristics. The basic function of this coil is to provide heat transfer at the top of the case, above the product. This heat transfer above the product will result in a gravity cooling effect by absorbing the heat that rises to the top of the case. The exact size, shape and number of cooling coil turns will depend on particular case requirements and coil characteristics plus cost considerations.

The cooling shelf 14 will provide a latent heat transfer between the product and the chilled liquid medium. The shelf will share the same chilled liquid supply used by the transparent cooling coil in a continuous cooling circuit. The shelf desirably includes the cooling circuit 15 internally thereof, as shown in phantom in FIG. 1 which shows a sinuous cooling channel, which is desirably transparent, to provide improved cooling efficiency. The shelf can be made of any material suitable for the food application. Since cleaning, removal and heat transfer are primary concerns, stainless steel is a preferred material. Here again, size and shape will depend on the needs of the particular application and specific case design. Increased thickness of the shelf may result in more liquid mass in the shelf, thus providing a greater amount of heat rejection.

Alternatively, the cooling shelf may be made of transparent material similar to the cooling coils in order to obtain a desired esthetic effect.

Naturally, other suitable heat exchangers may be employed than the plate heat exchanger 16 shown in FIG. 1. The plate heat exchanger is a conventional component that is gaining popularity in the commercial refrigeration industry. The increased popularity is primarily based on the increased efficiency of the design versus traditional shelf and tube type heat exchangers. Also, the reduced size of these types of heat exchangers make them very attractive. The primary purpose of this heat exchanger is to provide a heat transfer between the refrigerant gas on the primary side of the system, and the liquid being used for product cooling on the secondary side of the heat exchanger.

The liquid pump 18 will simply provide mass flow of the liquid in the system. However, the flow rate will effect the product and coil temperature. Increased flow rate will result in more cooling capacity and a reduced flow rate will result in a decreased cooling capacity. The lower flow rate will also result in a more uneven temperature across the shelf and coil surface. This uneven surface temperature is not desirable, thus pump sizing will need to be determined based on the total heat rejection needed and the heat rejection capacity of the shelf and coil for the particular system.

A liquid flow valve 20 will provide a low cost solution for liquid pump over-sizing. This valve will restrict flow through the shelf and coil as shown in FIG. 1, or the valve could bypass the liquid flow around the pump. In either case, when decreasing the flow rate or bypassing the flow from the outlet of the pump, back to the inlet of the pump, the net result will be a decrease in load on the plate heat exchanger. This will result in a need for freeze protection. Typically, the use of an Evaporator Pressure Regulator (EPR) valve is used to ensure the temperature of the plate heat exchanger. This is the most reliable and cost efficient way of handling varying load conditions in the system.

Other well known and conventional components (not shown) may be needed for control on both the primary and secondary side of the heat exchanger. The use of a thermostatic expansion valve (TXV) may be needed to meter the correct amount of refrigerant into the plate heat exchanger. This is typically referred to as a superheat control. An EPR valve may be needed to control the temperature of the plate heat exchanger. Ball valves may be employed to isolate the system for servicing. Relief valves may be necessary on the secondary side of the heat exchanger to allow release of air from the system. Other optional and conventional means of controlling temperature may be used as follows:

- Liquid line solenoid control based on case or product temperature,
- Electronic Expansion Valve (EEV) control,
- Electronic Evaporator Pressure Regulation (EEPR) control,
- Liquid pump cycling based on case or product temperature,
- Line sizing of the chilled liquid lines. This method changes flow rate and thus changes the temperature on the product or case. However, these are cell conventional components, do not form a part of the present invention and are not specifically illustrated herein.

Figure 2:
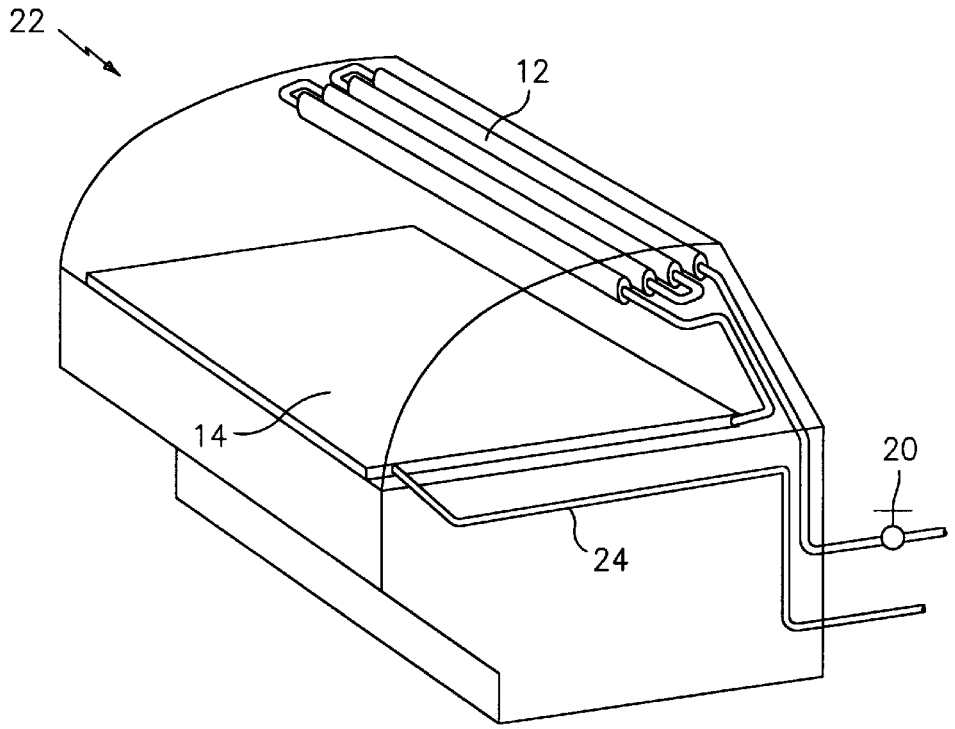
FIG. 2 is a perspective view of an alternate embodiment of a temperature controlled case of the present invention.

FIG. 2 shows an alternate embodiment of a case 22 of the present invention employing liquid filled transparent cooling coil 12 and liquid filled cooling shelf 14, as in FIG. 1. However, cooling line or channel 24 goes to a remote chiller, secondary cooling system or cold ambient condition (not shown) to cool the liquid rather than using the plate heat exchanger shown in FIG. 1. Optional liquid flow valve 20 is also employed. Case 22 of FIG. 2 would have the same benefits as case 10 of FIG. 1. The primary difference is, instead of cooling the liquid at the case, the liquid is cooled at a separate location. In both case designs, the liquid flow valve 20 is an optional device for temperature control.

All units of the present invention may if desired use a cover, as a transparent cover, based on particular needs, which may be readily opened as needed, or may be completely removable to allow the case to serve as either a service case and a refrigerated table. Also, the transparent cooling coil may if desired be used effectively without the internally cooled shelf, or vice versa, although the combination of these features will lead to best results.

Figure 3:
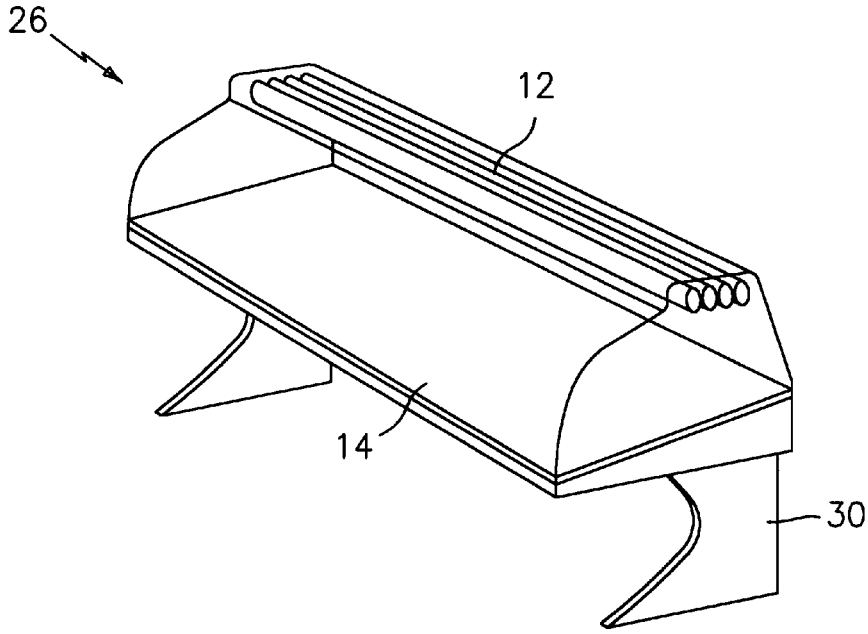
FIGS. 3–4 are perspective views of further embodiments of a temperature controlled case of the present invention.
Figure 4:
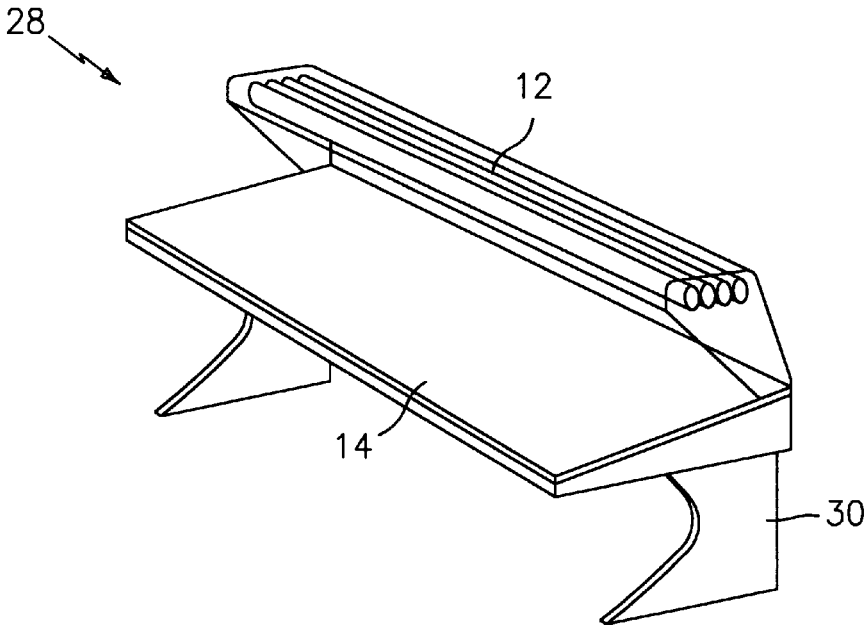

The case design may be changed for appearance as shown for example in FIGS. 3 and 4. The design of FIGS. 1 and 2 represents a fairly traditional case design. The design of FIGS. 3 and 4, which shows cases 26 and 28, respectively, uses pedestal legs 30, which may be made of a transparent material, as for example plexiglass, instead of sheet metal which of course may also be used if desired. Cases 26 and 28 also include cooling coils 12 and cooling shelf 14, with a cooling line similar to that shown in FIG. 2.

The purpose of the cooling coils 12 and the cooling shelf 14 in FIGS. 3–4 is the same as in FIGS. 1–2. The cooling shelf provides a direct latent heat transfer between the product and the cooling system. However, the streamlined design shown in FIGS. 3 and 4 may desirably use a shelf of transparent material. Also, the shelf may or may not share the same cooling liquid as the cooling coil. Regardless of the cooling source, the combination of a cooling shelf with internal cooling and a cooling coil as in the present invention would encapsulate the product in a controlled environment, provide efficient cooling and represent an esthetically pleasing system. The change to a transparent shelf design would add a new marketing feature to the case. Based on the type of product in the case, the product background color could easily be changed by adding a dye to the cooling liquid, thus changing the shelf color. Because of the ability to change the shelf color, the use of paper or plastic trays to vary the product background is no longer necessary. Also, by using the cooling shelf as the direct product background, as opposed to a tray or paper, better contact to the cooling surface will be achieved. This will now give the product the same effect as laying it on a bed of ice! The case superstructure may desirably change from metal to a transparent material as indicated hereinabove. This will make the case as transparent to the customer as possible. The plate heat exchanger (if used), drip pan, and associated valves would be mounted directly under the cooling shelf. Then, when coloring the shelf, these items will be effectively hidden from the view of customers.

The designs of FIGS. 3–4 are effectively dual-purpose designs. With the clear glass product cover in place as shown for example in FIGS. 1–2, the case is suited for a service case function. This case design would be used in meat, deli and fish departments. However, by removing the glass front of the case, as shown in FIGS. 3–4, the case could be used as a refrigerated service table. This cover may be removed and the case could them be used for packaged products. Moreover, these designs incorporate the significant advantages of the present invention.

Further advantageous features of the present invention are shown in FIGS. 5–8 and are directed to access to the product. Thus, closed cases may have doors or openings at the rear of the case for the store personnel to conveniently retrieve the product or to supply additional product. However, this location allows the controlled environment within the case to be degraded. In accordance with this feature of the present invention, the access opening is placed higher up on the case above the case load limit. This permits the conditioned environment within the case to be much less effected. The net result is lower cost for refrigeration and better product temperature control.

Figure 5:
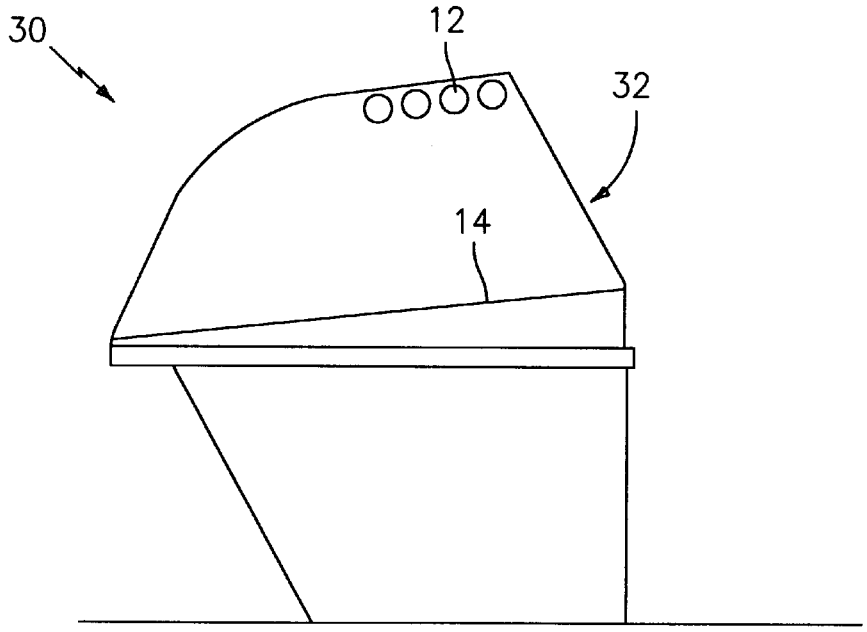
FIG. 5 shows a temperature controlled case with conventional access for store personnel.

Thus, FIG. 5 shows a typical closed service case 30, including the features of the present invention, as transparent cooling coils 12 and cooling shelf 14. Product access opening 32 is from the rear of the case, as for example a sliding door, which allows service personnel to access the product. Customers and store personnel are at the same eye level. Cases using this type of access are typically low profile to allow store personnel and customer to communicate. The problem with this design is it allows most of the controlled environment to spill from the case while the doors are open. When the doors are closed again, the environment has to pull down the temperature of the zone again. This pull down cycle creates two negative side affects.

1) The refrigeration equipment to handle the increased load uses more energy.
2) Constant swings in product temperature degrade product life in the case.

Figure 6:
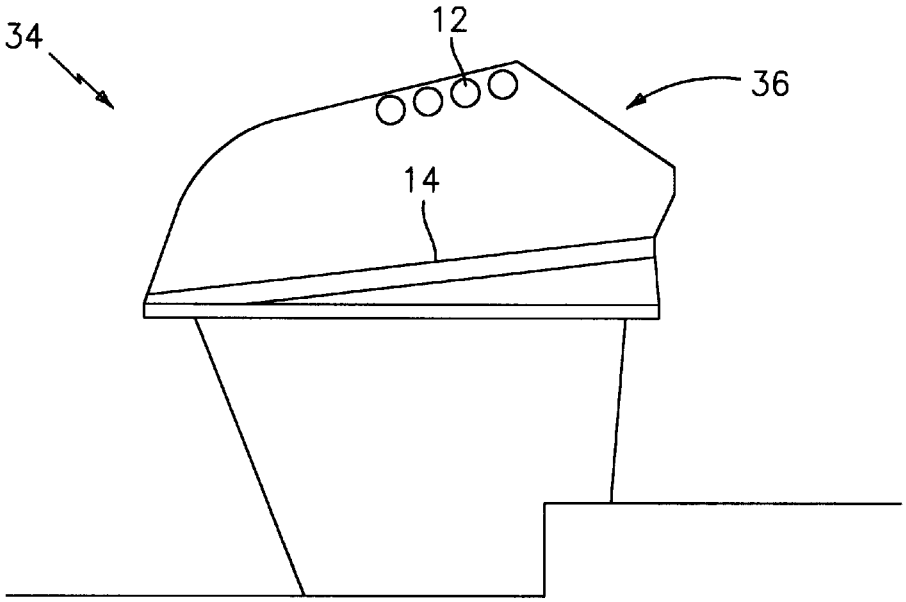
FIG. 6 shows a case similar to FIG. 5 with access variation according to the present invention.

In accordance with the design of FIG. 6 for case 34 product access opening 36 is moved more to the top of the case. As we all know, cold air falls and warm air rises. With the opening at the top of the case, more like a "coffin" type case, the cold air is trapped within the case. This type of opening forms the air curtain more at the top; this is an ideal situation. The illustration of FIG. 6 is somewhat schematic and naturally actual case design may vary based on particular requirements within the parameters of the present invention.

Figure 7:
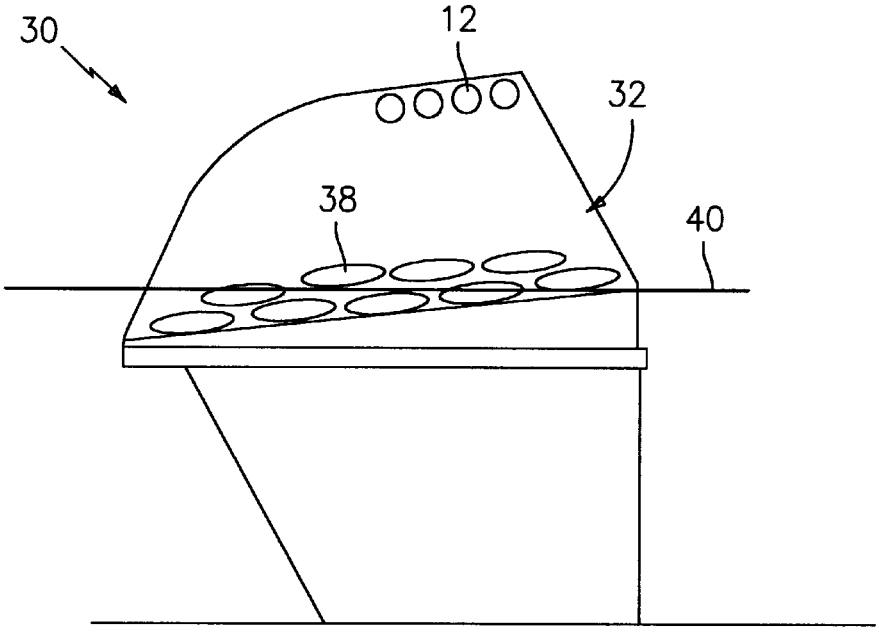
FIG. 7 shows the case of FIG. 5 including product.
Figure 8:
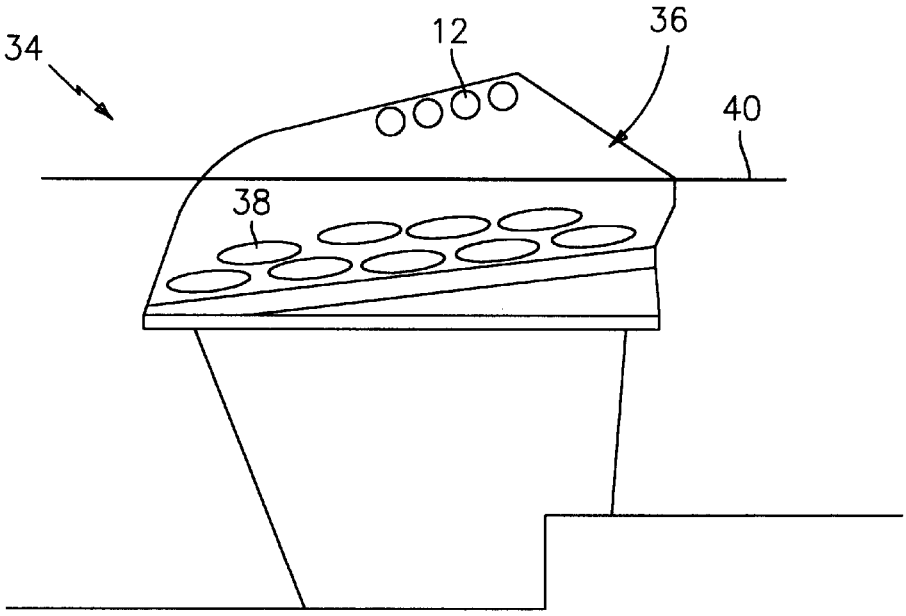
FIG. 8 shows the case of FIG. 6 with product.

FIGS. 7 and 8 show cases 30 and 34, respectively, with product and with the case load limit shown. Thus case 30 includes product 38 therein with the case load limit 40 shown. As can be readily seen, a major portion of product 38 is at or above the load limit when the case is open. Thus, when the product is above the load limit, the product warms quickly during extended periods of door openings. Not only does the cold air escape, but warm air is allowed to infiltrate the case and attack the product. However, as shown in FIG. 8, by moving the access opening higher up on the case and closer to the top of the case, the load limit is raised allowing the product to desirably remain under the load limit. Having the product below the cases load limit at all times allows longer periods of door openings, and can even eliminate doors entirely. Moreover, this is particularly useful in conjunction with the features of the present invention described heretofore.

The present invention achieves significant advantages. A transparent cooling coil, as of glass, plexiglass or other transparent material, is esthetically pleasing and far less noticeable in the case as well as providing increased design flexibility. Since the material is transparent, a shielding will not be needed to conceal the coil. When used in conjunction with a clear or transparent cooling medium, such as for example water, the coil will go virtually undetected. If there is a need or desire to color the coil, as for esthetic reasons, one can simply add a dye to the cooling liquid.

Moreover, the shelf design with internal cooling coils, can be made from the standard painted metal or stainless steel; however, the internal cooling coils will materially enhance the cooling effect. Moreover, a transparent shelf design, with chilled liquid pumped therethrough, can be left clear or colored for the desired esthetic effect. Because the shelf is the actual background for the product on display, store marketing personnel can easily pick a color that best suits their marketing needs. Still further, the placement of the product access opening higher up on case provides significant cost savings and more effective product cooling.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A temperature controlled case for storage and display of chilled or frozen products, which comprises: at least one compartment for product storage; at least one access opening providing entrance to said compartment; at least one shelf within said compartment for holding product; and refrigeration means operatively associated with said compartment for maintaining a selected temperature therein, wherein said refrigeration means includes (1) at least one cooling coil above said shelf with a liquid cooling medium flowing therethrough, wherein the cooling coil and liquid cooling medium do not detract from the visual appearance above said shelf, and (2) cooling within said shelf with a cooling medium flowing therethrough, to provide a cooled, temperature controlled environment for the product.

2. A case according to claim 1, including at least one transparent or semi-transparent cooling coil above the shelf with a transparent liquid cooling medium flowing therethrough.

3. A case according to claim 2, including a cooling channel within said shelf, wherein said liquid cooling medium flows within the cooling shelf and cooling coil in a continuous cooling circuit.

4. A case according to claim 3, including a flow circuit for said liquid cooling medium including a liquid pump, a heat exchanger and a liquid flow valve.

5. A case according to claim 4, wherein said heat exchanger is a plate heat exchanger.

6. A case according to claim 4, wherein said heat exchanger includes a secondary cooling system.

7. A case according to claim 3, wherein said shelf is stainless steel.

8. A case according to claim 3, including a transparent cooling shelf and transparent cooling channel within said shelf.

9. A case according to claim 3, including transparent pedestal legs for said case.

10. A case according to claim 1, wherein said cooling coil is transparent and said liquid cooling medium is transparent.

11. A case according to claim 1, wherein said cooling coil is colored and the cooling coil is transparent.

12. A case according to claim 1, wherein said case has a case load limit and wherein said access opening is above the case load limit.

13. A case according to claim 1, including a cover over said shelf.

14. A case according to claim 13, wherein said cover is removable so that the case is operative to function as a service case with the cover in place and as a refrigerated service table with the cover removed.

* * * * *

UNITED STATES PATENT AND TRADEMARK OFFICE

CERTIFICATE OF CORRECTION

PATENT NO. : 6,185,951 B1 
DATED : February 13, 2001
INVENTOR(S) : Mark Lane and Michael B. Davidson It is certified that error appears in the above-identified patent and that said Letters Patent is hereby corrected as shown below:

Column 6,
Lines 63-64, the portion reading "wherein said refrigeration means includes (1) at least one cooling coil above said shelf with a liquid cooling medium" should read as follows: -- wherein said refrigeration means includes (1) at least one --transparent or semi-transparent-- cooling coil above said shelf with a liquid cooling medium --

Signed and Sealed this

Fifteenth Day of June, 2004

JON W. DUDAS
*Acting Director of the United States Patent and Trademark Office*